US007631620B2

(12) United States Patent
Chepettchouk

(10) Patent No.: US 7,631,620 B2
(45) Date of Patent: Dec. 15, 2009

(54) VARIABLE COMPRESSION RATIO MECHANISM FOR AN INTERNAL COMBUSTION ENGINE

(75) Inventor: Victor Chepettchouk, 46 Grand Oak Drive, Richmond Hill, On (CA) L4E 3Z9

(73) Assignee: Victor Chepettchouk, Richmond Hill, Ontario (CA)

( * ) Notice: Subject to any disclaimer, the term of this patent is extended or adjusted under 35 U.S.C. 154(b) by 98 days.

(21) Appl. No.: 11/687,642

(22) Filed: Mar. 17, 2007

(65) Prior Publication Data

US 2008/0223320 A1 Sep. 18, 2008

(51) Int. Cl.
*F02D 15/02* (2006.01)
*F02B 75/04* (2006.01)

(52) U.S. Cl. ..... 123/48 B; 123/78 F; 123/197.4

(58) Field of Classification Search ..... 123/48 B, 123/78 E, 78 F, 197.3, 197.4
See application file for complete search history.

(56) References Cited

U.S. PATENT DOCUMENTS 3,886,805 A * 6/1975 Koderman ..... 74/52
4,485,768 A * 12/1984 Heniges ..... 123/48 B
5,170,757 A * 12/1992 Gamache ..... 123/197.4
5,465,648 A * 11/1995 Cy ..... 92/140
5,755,195 A * 5/1998 Dawson ..... 123/197.4
5,894,763 A * 4/1999 Peters ..... 74/598
5,908,014 A * 6/1999 Leithinger ..... 123/78 F
6,006,619 A * 12/1999 Gindentuller et al. ..... 74/44
6,247,430 B1 * 6/2001 Yapici ..... 123/78 F
6,349,684 B1 * 2/2002 de Gooijer ..... 123/78 F
6,443,106 B1 * 9/2002 Pischinger et al. ..... 123/48 B
6,450,136 B1 * 9/2002 Klomp et al. ..... 123/78 E
6,564,762 B2 * 5/2003 Dow ..... 123/78 F
6,588,384 B2 7/2003 Yapici
6,948,460 B1 * 9/2005 Dow ..... 123/48 B
7,007,640 B2 * 3/2006 Sakita ..... 123/78 F
7,011,052 B2 * 3/2006 Dow ..... 123/48 B
7,150,259 B2 * 12/2006 Schmied ..... 123/197.5
7,174,865 B2 * 2/2007 Sakita ..... 123/78 F
7,293,542 B2 * 11/2007 Ozdamar ..... 123/197.1

* cited by examiner

*Primary Examiner*—Hai H Huynh

(57) ABSTRACT

An internal combustion engine has a mechanism to control crankshaft axis position and control combustion chamber compression ratio. The mechanism includes control ring, rotatably supporting crankshaft, and rotatably installed in the engine housing. The control shaft is installed in the engine housing and parallel to the crankshaft. The control shaft pinion elements meshing with control ring toothed elements, and rotating control ring, resulting in changing of crankshaft relative position to the cylinder head; this will change engine compression ratio. The crankshaft toothed part constantly meshing with toothed part of the engine output shaft, transferring rotary moving force from crankshaft to engine output shaft.

10 Claims, 4 Drawing Sheets

VIEW B-B

VIEW B-B (Output shaft with internal toothing)

VIEW C-C

VARIABLE COMPRESSION RATIO MECHANISM FOR AN INTERNAL COMBUSTION ENGINE

BACKGROUND OF THE INVENTION

This invention relates to the mechanism for changing compression ratio of internal combustion engine, and transferring rotational force from adjustable crankshaft to the engine power output shaft.

Using the variable compression ratio (VCR) mechanism can improve engine economy, performance, and allow use of different fuel types. Therefore VCR engines were described in many patents. U.S. Pat. No. 6,588,384 proposed to use eccentric ring to adjust crankshaft position.

SUMMARY OF THE INVENTION

It is an object of the present invention to provide improved mechanism for controlling internal combustion engine compression ratio, easy for installation and manufacturing, avoid use of eccentric rings, and improving transferring rotational force from crankshaft.

The control mechanism has control rings with toothed element, rotatably supported in the engine housing and providing rotatable support for crankshaft. The control shaft is installed in engine housing.

Mechanism includes plurality of control shaft pinions and control ring's toothed elements.

Control shaft pinions meshing with control ring toothed elements.

Control rings, control shaft and crankshaft have parallel rotation axis.

When compression ratio adjustment is required, control shaft rotation will rotate control rings, resulting in changing crankshaft position relatively to the cylinders' head.

Another aspect of the present invention is that the engine output shaft is rotatably supported in the engine housing, and has the same rotational axis as the control rings.

Crankshaft toothed part constantly meshing with engine output power shaft toothed part transfers rotational force. When control ring rotating, the crankshaft rotational axis moving on the fixed radius around engine output shaft rotational axis, providing constant meshing of crankshaft toothed part and engine output shaft. The engine output shaft transfers rotational force from crankshaft to transmission or other devices.

DETAILED DESCRIPTION OF THE INVENTION

Refer to drawings FIG. 1 to FIG. 6, where the same corresponding parts are represented through several views.

Figure 1:
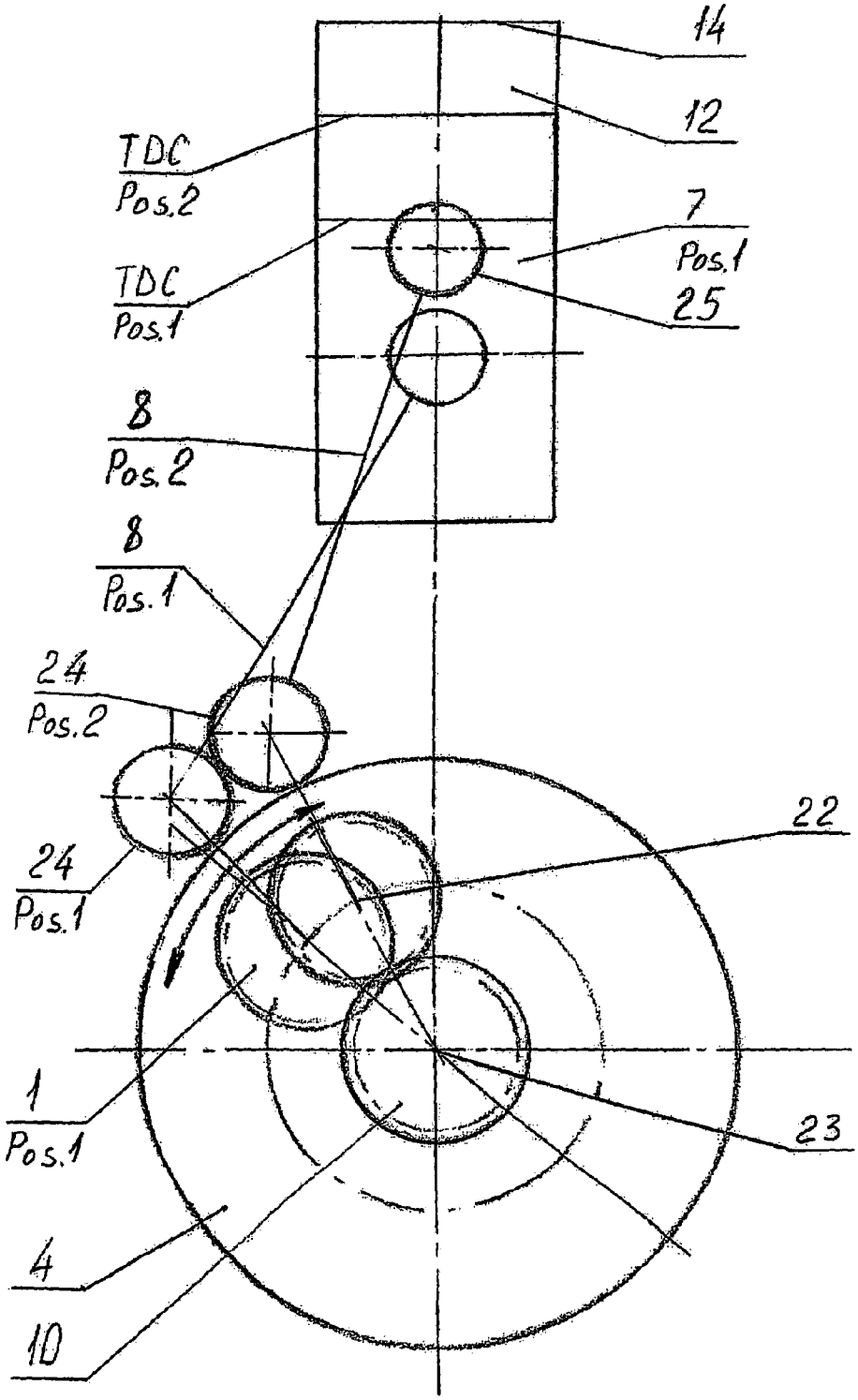
FIG. 1 is a schematic view of VCR mechanism.

FIG. 1 presents a schematic view of the variable compression ratio (VCR) mechanism.

The piston 7, cylinder 9 (see FIG. 2) and cylinder head 14 forming combustion chamber 12. Piston rod 8 has bearing portion 25 connected to cylinder 7 and bearing portion 24 connected to the crankshaft 1. The crankshaft 1 rotatably supported in control ring 4 on bearing 2 (see FIG. 3). The crankshaft 1 rotational axis 22 is spaced from control ring rotational axis 23.

Combustion chamber has minimum volume, when piston 7 is at TDC (Top Dead Center), and maximum volume, when at BDC (Bottom Dead Center) position. CR (Compression Ratio) is the ratio of volume at BDC to the volume at TDC.

As seen in FIG. 1 the compression ratio will be changed, when control ring 4 rotates resulting in crankshaft 1 relative position change to the cylinder head, therefore TDC and BDC will be changed, and as a result CR will be changed. When control ring 4 rotation will change crankshaft Pos. 1 to Pos. 2, CR will be increased.

Figure 2:
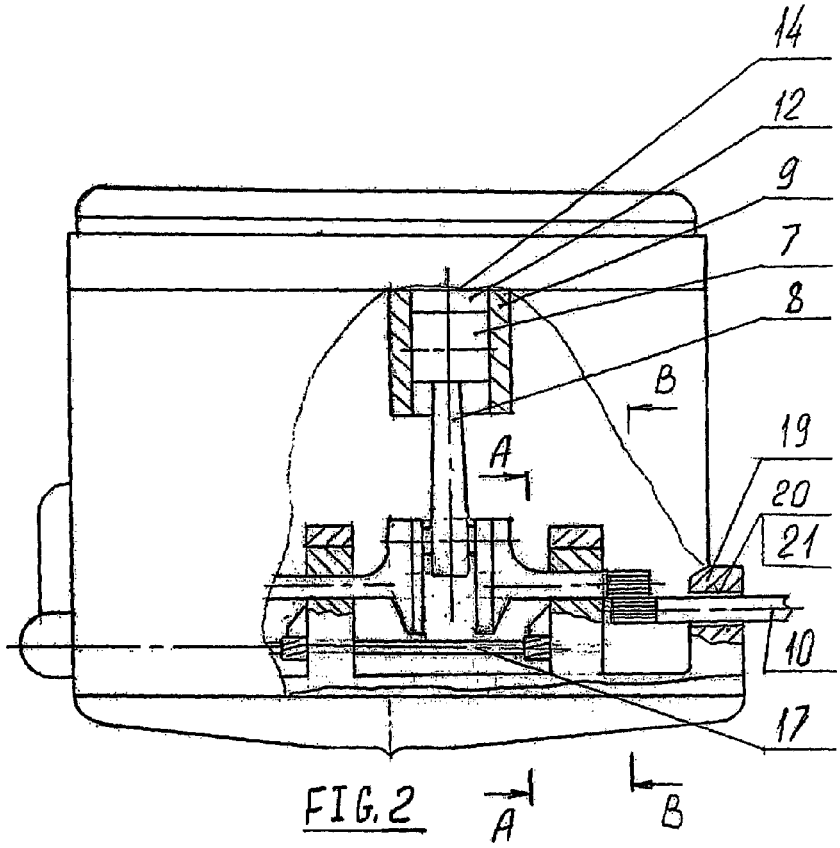
FIG. 2 is a sectional end view of an internal combustion engine presenting invention.
Figure 3:
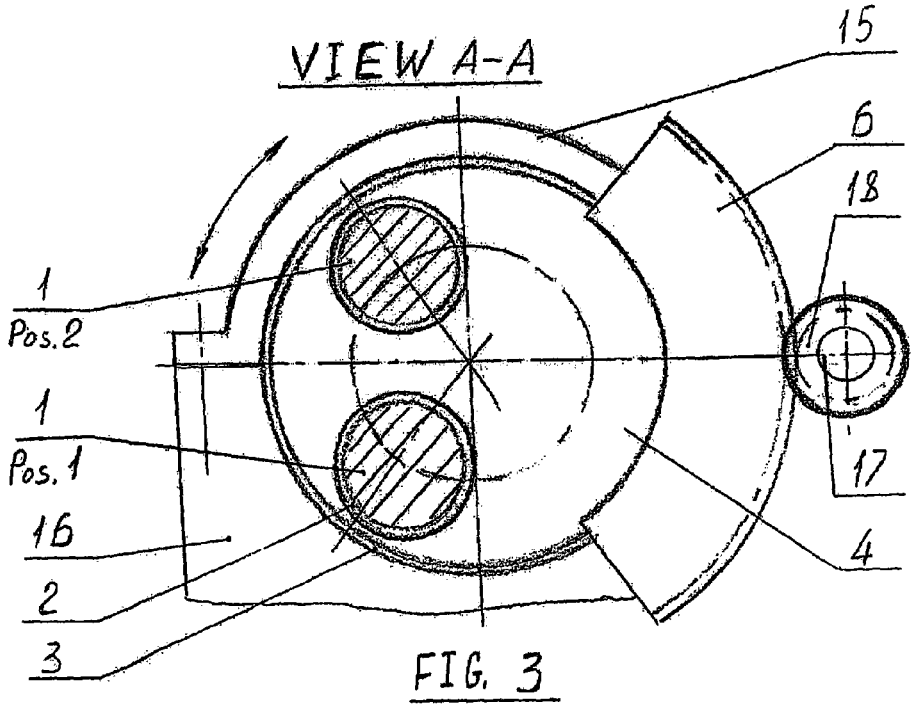
FIG. 3 is a sectional A-A view of FIG. 2 presenting control ring adjustment.

FIG. 2 and FIG. 3 show functions described above; control ring 4 rotatably installed in engine housing 15, 16 on optional bearing 3. Engine housing 15 and 16 prevent control ring 4 axis movement, and allow control ring 4 rotation. Toothed element 6 is attached to control ring 4. And control shaft 17 installed in engine housing.

As shown in FIG. 3 toothed pinion 18 installed on control shaft 17. The jackscrew type pinion 18 constantly meshing with toothed element 6.

When compression ratio adjustment is required, control shaft 17 and pinions 18 rotation will be transferred to control rings 4, resulting in changing crankshaft 1 position relatively to the cylinders' head 14.

Crankshaft 1 rotational force has to be transferred to the engine power output shaft 10 during constant CR and during adjustment, when crankshaft position has to be changed.

Figure 4:
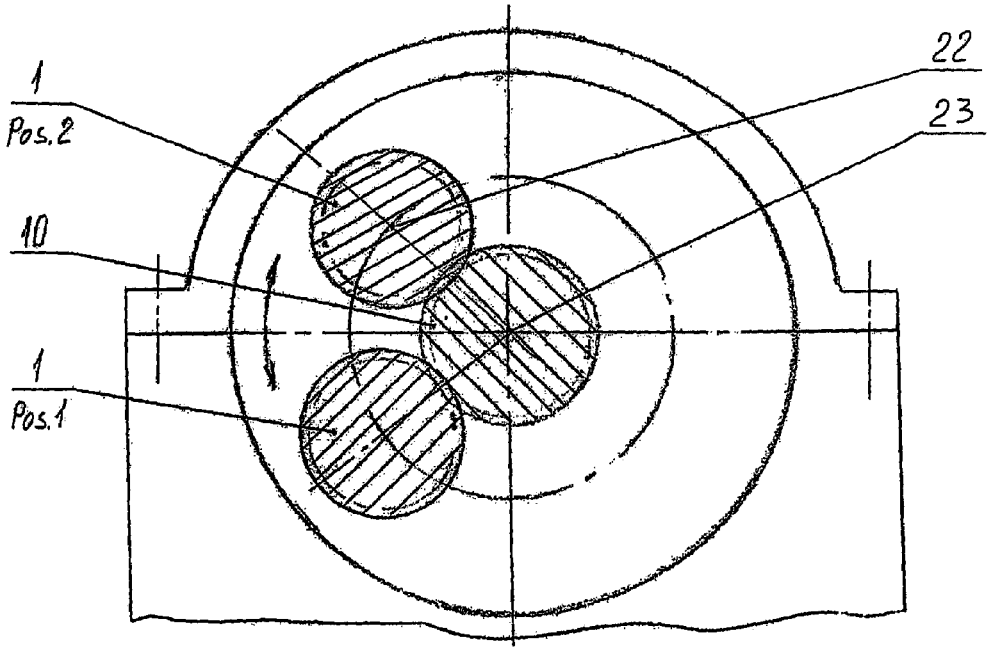
FIG. 4 is a sectional B-B view of FIG. 2 presenting crankshaft and engine power shaft permanent meshing.
Figure 6:
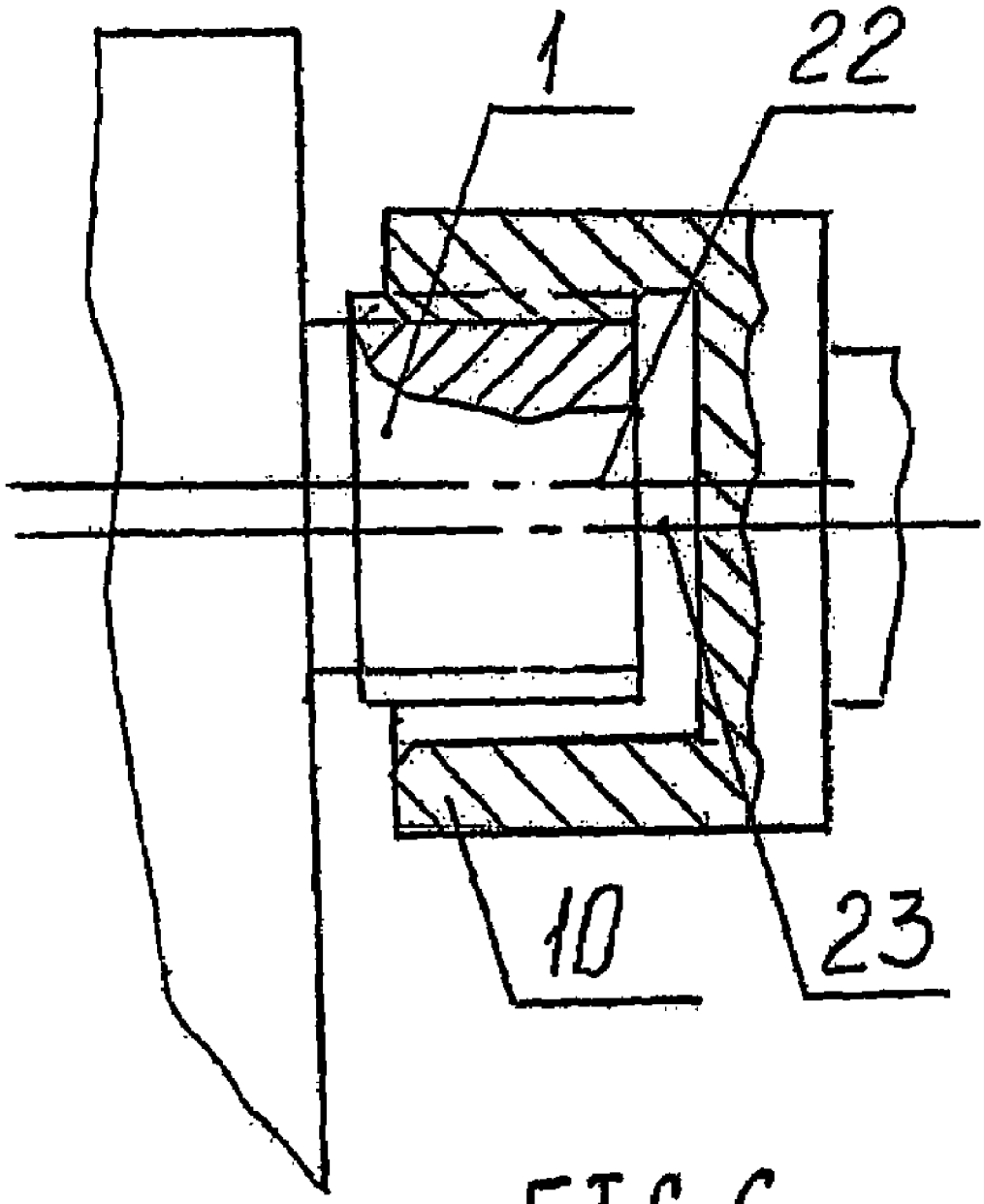
FIG. 6 is a sectional C-C view of FIG. 5.

To support this function engine output power shaft 10 is rotatably supported in the engine housing 16 and 19 on bearing 20, and has the same rotation axis 23 as control ring 4 as shown in FIGS. 1, 4, 6.

During CR adjustment, control ring 4 rotating on axis 23, causing the crankshaft rotational axis 22 to move on the fixed radius around engine output shaft/control ring rotational axis 23, supporting constant meshing of crankshaft toothed part and engine output power toothed part. As shown in FIG. 2 crankshaft 1 has a toothed part, which constantly meshing with toothed part or engine output power shaft 10.

Figure 5:
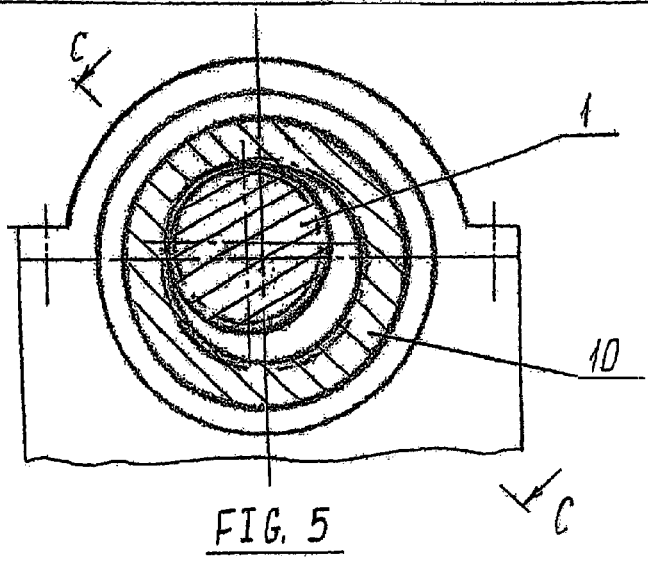
FIG. 5 is an alternative construction of crankshaft to engine output power shaft permanent meshing.

To reduce control ring 4 diameter, crankshaft 1 with toothed part forming outer gear and engine power output shaft 10 with toothed part forming inner gear as shown on FIG. 5 and FIG. 6 could be used.

To control CR, ECM will receive engine sensors data such as temperature and knocking and generate command, which will be sending to the drive mechanism, mechanically connected with control shaft. Control shaft and/or control rings position feedback will be sent back to ECM.

Seal 21 prevents engine leakage and/or engine contamination.

The engine output power shaft 10 transfers rotational force from crankshaft 1 to transmission or other devices.

What is claimed is:

1. The mechanism for controlling compression ratio of internal combustion engine, including engine housing, piston, mounted in cylinder and forming combustion chamber, piston rod connected with crankshaft and comprising:

crankshaft rotatably installed in control rings, control ring rotatably installed in engine housing rotatably supported and adjusting crankshaft position, bearing for supporting control ring in engine housing, bearing for supporting crankshaft in control ring, each control ring toothed element, control shaft with pinion elements supported in engine housing, each control shaft pinion meshing with respective control ring toothed element, engine power shaft rotatably supported in engine housing, with toothed part constantly meshing with crankshaft toothed part, bearing for supporting engine power shaft, sealing to prevent oil leaking, and engine contamination a piston rod connected at one end to a piston pin and at the other end to a crankshaft through a crankpin.

2. The mechanism as defined in claim 1 further comprising:

crankshaft and engine power shaft having internal/external toothed parts providing constant meshing during static crankshaft position, and during crankshaft position adjustment.

3. The mechanism as defined in claim 1 further comprising:

a plurality of control rings supported in engine housing and rotatably supporting crankshaft.

4. The mechanism as defined in claim 3 further comprising:

control ring's rotation axis is parallel and spaced to crankshaft rotation axis.

5. The mechanism as defined in claim 1 further comprising:

a control shaft pinion meshing with control ring toothed element, providing control ring rotation, and crankshaft position change compare to engine cylinders head.

6. The mechanism as defined in claim 1 further comprising:

an engine output power shaft toothed part constantly meshing with crankshaft toothed part, and has the same rotation axis as the control rings.

7. The mechanism as defined in claim 6 further comprising:

an engine output power shaft can have internal toothed part forming inner gear constantly meshing with crankshaft external toothed part forming outer gear.

8. The mechanism as defined in claim 6 further comprising:

an engine output power shaft having external toothed part forming outer gear constantly meshing with crankshaft external toothed part forming outer gear.

9. The mechanism as defined in claim 1 further comprising:

control ring and engine power shaft have the same rotation axis, when control ring rotating, the crankshaft rotational axis moving on the fixed radius around engine output shaft rotational axis.

10. The mechanism as defined in claim 1 further comprising:

control ring, crankshaft support bearing, control ring support bearing, engine housing supporting control ring bearing, or control ring, are composed from two parts.

* * * * *